United States Patent [19]

Steineman

[11] 4,350,201

[45] Sep. 21, 1982

[54] SELF FIXTURING HEAT EXCHANGER

[75] Inventor: Robert J. Steineman, West Carrollton, Ohio

[73] Assignee: United Aircraft Products, Inc., Dayton, Ohio

[21] Appl. No.: 224,035

[22] Filed: Jan. 12, 1981

[51] Int. Cl.[3] ..... F28F 3/10

[52] U.S. Cl. ..... 165/76; 165/166

[58] Field of Search ..... 165/76, 166, 167; 29/157.3 D

[56] References Cited

U.S. PATENT DOCUMENTS

| | | | |
|---|---|---|---|
| 1,635,838 | 7/1927 | Haber | 165/166 |
| 2,368,814 | 2/1945 | Fagan | 165/166 |
| 2,961,222 | 11/1960 | Butt | 165/166 |
| 3,071,187 | 1/1963 | Fairbanks | 29/157.3 D |
| 3,542,124 | 11/1970 | Manfredo | 165/166 |
| 4,308,915 | 1/1982 | Sanders et al. | 165/166 |

FOREIGN PATENT DOCUMENTS

| | | | |
|---|---|---|---|
| 1272343 | 4/1961 | France | 165/166 |
| 2043865 | 10/1980 | United Kingdom | 165/166 |
| 626345 | 9/1978 | U.S.S.R. | 165/166 |

*Primary Examiner*—Sheldon Richter

*Attorney, Agent, or Firm*—J. E. Beringer

[57] ABSTRACT

A heat exchanger of the plate and fin type which due to the presence of interacting parts is inherently self fixturing in assembly, obviating a need for a holding fixture in assembly and preparatory to and during brazing. The heat exchanger features use of a plate element formed to restrict relative motion of underlying and overlying parts and universally usable in a heat exchanger core stacking process.

9 Claims, 5 Drawing Figures

SELF FIXTURING HEAT EXCHANGER

BACKGROUND OF THE INVENTION

This invention relates to heat exchangers of the plate and fin type, and particularly to a generally new plate element the use of which makes a heat exchanger inherently self fixturing.

The core of a heat exchanger of the plate and fin type comprise plate elements alternating with fin elements, spacer members interposing between plate elements and along side fin elements and defining separated fluid flow passages. In assembly a core, parts are loosely stacked one upon another, and, when assembly is complete, a brazing operation joins the parts in a unitary whole. To hold parts in a properly assembled relation, prior to brazing, stacking is usually accomplished in a fixture, which continues to hole the parts during brazing. The use of a fixture is an added complication and expense in core fabrication, especially when, as is frequently the case, special fixtures must be designed, and kept on hand, to match special core configurations. A principle of self fixturing, by which parts mate with one another and so inhibit misalignment, has been suggested heretofore, as in the U.S. Pat. No. to Coolidge 3,805,889. The prior art concept, however, does not deal with problems of total confinement, nor does it illustrate how a conventional heat exchanger can be made self fixturing using simple modifications of the usual parts.

SUMMARY OF THE INVENTION

A plate and fin heat exchanger in accordance with the present invention has no requirement for fixturing neither in its assembly nor in its brazing. In its illustrated embodiment, the invention provides conventional elements conventionally stacked one upon another. Plate elements, however, are specially configured to achieve a confining relation to fin elements and to spacer members in overlying and underlying relation thereto. Marginal edge portions of the plate elements are turned over in selected fashion to achieve the desired ends. In particular, each plate edge has tabs of different length and of different directional orientation thereon cooperating in a total confinement of associated parts, without obstructing fluid flow. A plate element of single design is reversibly applicable in a heat exchanger core assembly and may serve both as a tube sheet in the body of the core and as a core sheet at ends thereof.

An object of the invention is to provide a self fixturing heat exchanger substantially as set forth in the foregoing.

Other objects and structural details of the invention will more clearly appear from the following description, when read in connection with the accompanying drawings, wherein.

Figure 1:
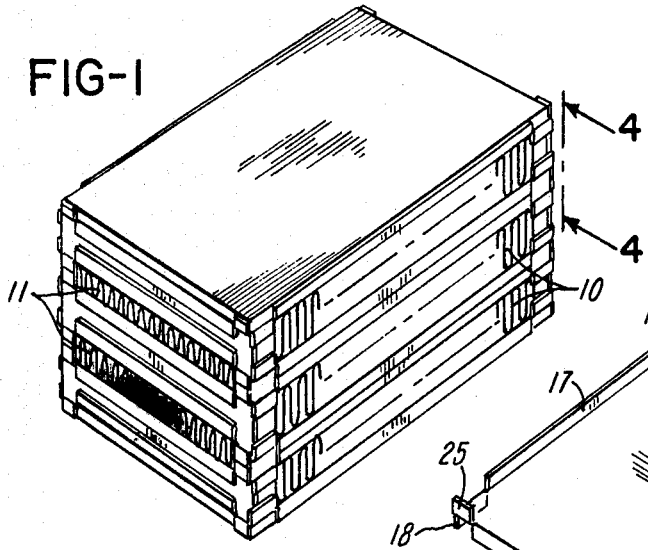
FIG. 1 is a view in perspective of a self fixturing heat exchanger core in accordance with the illustrated form of the invention.

Referring to the drawings, a self fixturing heat exchanger in accordance with the illustrated embodiment of the invention is conventinal in that it is comprised of fin elements 10 and 11, spacer members 12 and 13, end plats 14 and 15 and intermediately positioning separator plates 16. For convenience, and in accordance with terminology normally used in the art, the end plates 14 and 15 will be identified herein as core sheets and intermediately positioning plates 16 as tube sheets. Also, and as will more clearly appear, the core sheets do not in the present instance from a necessary part of the assembly since tube sheets 16 at upper and lower limits of the core provide adequate end closures.

Figure 2:
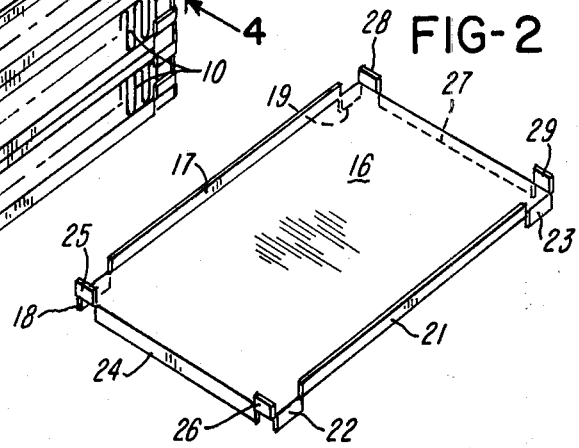
FIG. 2 is a detail view in perspective of a plate element comprised in the assembly of FIG. 1.

The tube sheets are used in such number as is required by the number of flow passages to be provided by the heat exchanger core. They are identical in construction so that a description of one will suffice for all. Thus, and referring to FIG. 2, a core sheet in accordance with the illustrated invention embodiment is a flat, plate-like element made of a heat conductive, relatively deformable material, for example an aluminum alloy. The sheet is rectangular in configuration. Along one side edge is a relatively elongated up turned tab 17, and, at ends thereof, relatively shorter length down turned tabs 18 and 19. Along the opposite side edge are like tabs 21, 22 and 23. Along one of the shorter edges of the sheet is a relatively elongated down turned tab 24 and up turned tabs 26. At the opposite one of the shorter side edges are like tabs 27, 28 and 29. The several tabs 17–29 are bent out of the plane of sheet 16 and position substantially perpendicularly of such plane. The tabs have a common, relatively short, height. The arrangement, as is evident, is one to project tabls along each edge of the sheet in a sense oppositely of one another and to project what might be regarded as corresponding tabs on long and short edges in a sense oppositely of one another.

Figure 3:
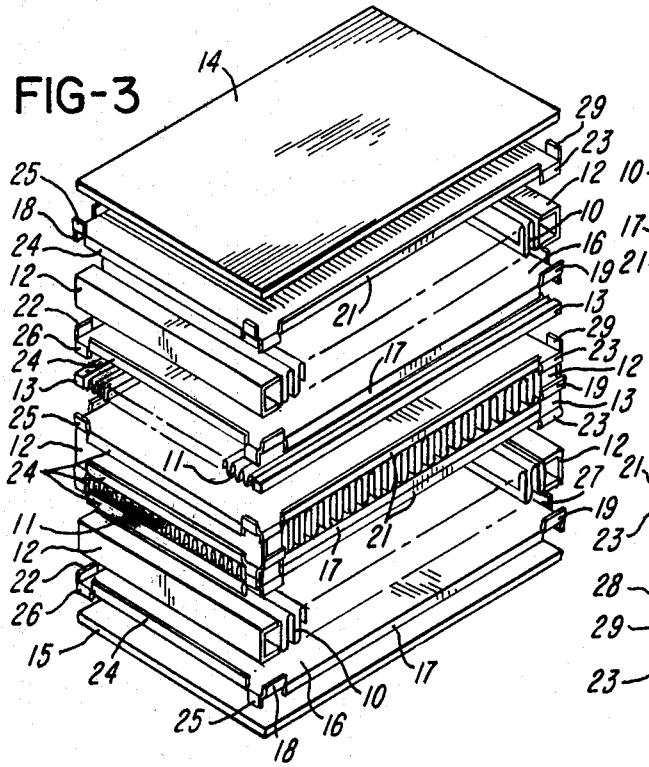
FIG. 3 is a view like FIG. 1, the parts being shown in an exploded relation.
Figure 4:
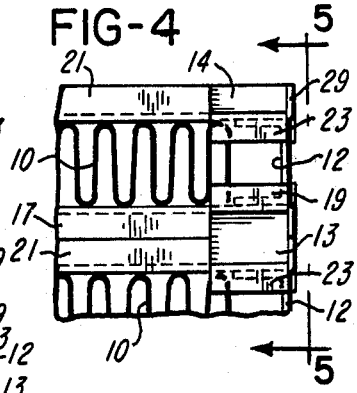
FIG. 4 is a fragmentary view taken substantially along the line 4—4 of FIG. 1.
Figure 5:
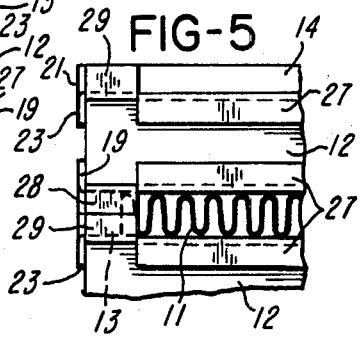
FIG. 5 is a fragmentary view taken substantially along the line 5—5 of FIG. 4.

In assembling a heat exchanger, a tube sheet 16 is placed on a supporting surface, either in the presence or absence of an interposing core sheet 15. Assuming the sheet to have been placed in the orientation of FIG. 3, which is the reverse of that shown in FIG. 2, a spacer member 12 is placed on the upwardly facing surface of the tube sheet, at each end thereof, in a position to lie flush against and to be confined by the up turned tabs 24 and 27. At the same time, ends of one of the spacer members substantially abut and are confined by up turned tabs 18 and 22 while ends of the other spacer member similarly abut and are confined by up turned tabs 19 and 23. A fin strip 19 is placed on the surface of sheet 16 between the spacer members 12 and abuts respective members at its opposite ends. Tabs 18–19 and 22–23 have a length not only to extend across respective ends of adjacent spacer members 12 but also to extend across and interpose in front of at least one fin section of an installed fin element 10. The identified tabs accordingly serve not only to prevent endwise motion of the spacer members 12 but also to prevent endwise motion of a fin element 10. Bodily lateral motion of the spacer members 12 is prevented on the one hand by tabs 24 and 27 and by an interposed fin element 10.

The fin element 10 has a height corresponding substantially to the height of spacer members 12 so that the spacer members and fin element provide a substantially planar supporting surface upon which another tube sheet 16 may be placed, the tube sheet in this instance being installed in a sense inversely of or upside down relative to the first installed sheet. This tube sheet thus has the orientation pictured in FIG. 2 and its several downwardly projected tabs cooperate with upwardly projecting tabs of the first installed sheet in achieving an embracing relation to ends and sides of the spacer members 12 and to end portions of the fin element 10. At the same time, oppositely projected tabs 17 and 21 provide a means of lateral confinement for spacer members 13 which are mounted there against in a sense longitudinally of the tube sheet and in a sense transversely of the spacer members 12. A fin element 11 is placed between the spacer members 13 and the upstanding tabs 25–26 and 28–29 act in a manner believed obvious to confine the spacer members and the intermediately positioning fin 11 against endwise motion. In this instance, as in the instance of tabs 18–19 and 22–23, the tabs 25–26 and 28–29 have a length slightly to exceed the thickness of spacer members 13 so as to overlap a portion of an intermediately positioning fin 11. The fin 11 has a height corresponding approximately to the height of spacer members 13 and so a supporting surface is provided for another tube sheet 16 which is oriented in a sense inversely of or upside down relative to the immediately underlying tube sheet. Downwardly projecting tabs of the further applied tube sheet accordingly achieve an embracing relation to underlying spacer and fin parts substantially as has heretofore been described. In accordance with the number of flow passages to be built into the assembled core, stacking of the parts continues as described until the desired number of passages has been constructed. At this point a core sheet 14 may be applied or the last installed tube sheet 16 may simply be used as the end plate of the core. A suitable applied pressure may be used to urge the parts into a close intimate engagement with one another and the assembled core then subjected to a brazing operation, as for example by being heated in a furnace in the presence of an appropriate braze alloy. A simple weight may serve as a pressure applying means, no holding fixture being required since all parts are held against misalignment by the tab formations on the several tube sheets.

The core is self fixturing in assembly in that a mere superimposing of parts one upon another allows the projected tabs on the tube sheets to interengage over underlying and overlying parts, accomplishing automatically their alignment and confinement functions. The tabs accomplish their function without appreciable interference with fluid flow and it will be noted in this connection that the elongated tabs 17 and 21 and 24 and 27 of adjacent tube sheets project in a sense oppositely of one another or out of the flow paths as occupied by the fin elements 10 and 11.

The heat exchanger core selected for disclosing the invention embodiment is one of a conventional kind in which different fluids, at different temperatures, flow in a sense transversely of one another through separated passages. Heat transfer takes place through separator plates 16 and is supplemented by the fin elements 10 and 11 which occupy passage spaces and are in contact with underlying and overlying tube sheets. The height of the passages occupied by the fins 10, and therefore of the fins themselves, exceeds the height of the fins 11 and of the passages occupied thereby, in accordance with the illustrated construction which shows a heat exchanger core adapted for the flow of a gas and of a liquid in heat transfer relation to one another. Also in accordance with the illustrated embodiment, the spacer members 12 which assist in defining what may be regarded as a gas flow passage occupied by fin element 10 have a channel-like shape. Spacer members 13 are relatively small in cross section and are usually made solid as shown.

It will be obvious that variations in passage and part size are possible and it will be equally obvious that these and other modifications in the disclosed apparatus are possible within general concepts of the invention.

What is claimed is:

1. In a self fixturing heat exchanger of the plate and fin type wherein plate elements and fin elements are stacked loosely one upon another in an alternating relation and spacer members position to define flow passages through the heat exchanger and to confine the fin elements in a lateral sense, all prior to a brazing of the parts into a unitary assembly; an improved plate element marginal edge portions of which are turned over in a selective fashion to achieve a confining relation to fin elements and to spacer members in respective longitudinal senses and to achieve in conjunction with said fin elements a confining of said spacer members in a lateral sense, obviating a need for a special fixture to hold assembled parts for brazing.

2. A self fixturing heat exchanger according to claim 1, plate elements in a stacked heat exchanger comprised of multiple plate elements being identical to one another and adjacent plate elements positioning upside down or inversely of one another.

3. A self fixturing heat exchanger according to claim 1, said marginal edge portions having the form of tabs bent out of the plane of the plate element.

4. A self fixturing heat exchanger according to claim 1, wherein turned over portions of the plate element project in directions oppositely of one another for cooperative relation with fin elements and spacer members in both overlying and underlying relation to the plate element.

5. A self fixturing heat exchanger according to claim 4, the plate element having a rectangular configuration, parallel edges having like tab formations and corresponding tab formations at non-parallel edges being directed reversely of one another.

6. A self fixturing heat exchanger according to claim 5, plate elements in a stacked heat exchanger comprising multiple plate elements being identical to one another and adjacent plate elements positioning upside down or inversely of one another.

7. In a self fixturing heat exchanger of the plate and fin type wherein plate elements and fin elements are stacked loosely one upon another in an alternating relation and spacer members position to define flow passages through the heat exchanger, all prior to a brazing of the parts into a unitary assembly; an improved plate element marginal edge portions of which are turned over in a selective fashion to achieve a confining relation to fin elements and spacer members in respective overlying and underlying relation thereto, obviating a need for a special fixture to hold assembled parts for brazing, the plate element being multi-edged, each edge comprising an elongate upstanding tab and ajacent each end of said upstanding tab an oppositely turned shorter length tab, each of said shorter length tabs being long enough to position in blocking relation to an end of a respective spacer member and to at least a part convolution of an adjacent fin element confined by said spacer member.

8. A self fixturing heat exchanger according to claim 7, the plate element having a rectangular configuration, parallel edges having like tab formations and corresponding tab formations at non-parallel edges being directed reversely of one another.

9. A self fixturing heat exchanger according to claim 8, plate elements in a stacked heat exchanger comprising multiple plate elements being identical to one another and adjacent plate elements positioning upside down or inversely of one another.

* * * * *